US005727287A

United States Patent [19]

Hosken et al.

[11] Patent Number: 5,727,287

[45] Date of Patent: Mar. 17, 1998

[54] CHECK STRAP ASSEMBLY FOR A PASSENGER DOOR OF A MOTOR VEHICLE

[75] Inventors: Thomas E. Hosken, Ann Arbor; Anil K. Jain, Troy; Thomas B. Tran, Lake Orion, all of Mich.

[73] Assignee: Chrysler Corporation, Auburn Hills, Mich.

[21] Appl. No.: 779,583

[22] Filed: Jan. 7, 1997

[51] Int. Cl.[6] ..... E05F 5/02

[52] U.S. Cl. ..... 16/82; 16/334; 16/344; 16/86 A

[58] Field of Search ..... 16/82, 86 A, 86 B, 16/334, 344, DIG. 17; 292/270, 268, 266

[56] References Cited

U.S. PATENT DOCUMENTS 4,833,755 5/1989 Bonin ..... 16/86 A
4,879,785 11/1989 Tolle et al. ..... 16/82
5,173,991 12/1992 Carswell ..... 16/86 A
5,205,016 4/1993 Kulot et al. ..... 16/82

*Primary Examiner*—Chuck Mah
*Attorney, Agent, or Firm*—Thomas G. Pasternak

[57] ABSTRACT

A check strap assembly particularly for use with a passenger door of a motor vehicle includes an arm having a first end interconnected to the body of the vehicle and a second end interconnected to the vehicle door. The check strap assembly further includes a locating mechanism disposed within the door and attached to a forward panel of the door. The arm extends through an aperture located in the forward panel of the door and is translatable relative to the locating mechanism and the door. A seal member is provided which is operative to seal the aperture and the panel of the door. The seal member is carried by the arm such that the seal member abuts the panel of the door when the door is in the closed position and is spaced from the panel of the door when the door is in the fully opened position. The seal operates to protect the cooperating components of the check strap assembly from dirt, moisture and other contaminants when the vehicle door is in its closed position.

10 Claims, 2 Drawing Sheets

CHECK STRAP ASSEMBLY FOR A PASSENGER DOOR OF A MOTOR VEHICLE

FIELD OF THE INVENTION

The present invention relates, in general, to articulating doors for motor vehicles. More particularly, the present invention relates to a check strap assembly operative to positively locate a passenger door of a motor vehicle between a fully open position and a closed position which is protected from contamination.

DISCUSSION

In a conventional manner, passenger doors of motor vehicles are pivotally mounted to the vehicle body for movement between a fully open position and a closed position. Modernly, many such vehicle doors are designed to cooperate with a check strap which is operative for positively locating the door relative to the vehicle body. For example, the check strap is adapted to positively locate the vehicle door relative to the vehicle body at an intermediate position between a fully open position and a closed position. In situations where space laterally adjacent to a passenger door prohibits the door from fully opening, opening of the door to the intermediate position reduces incidents of unintentional damage to the door, to an adjacent vehicles, or both.

In one common form, prior check straps for vehicle doors include a roller mounted to the vehicle body and an arm contoured to cooperate with the roller which is carried by the vehicle door. In this regard, the arm is formed to include one or more camming surfaces. The roller functions as a cam follower. As the door is moved between its fully open position and its closed position, the arm remains in constant engagement with the roller. When the door is gently opened or closed, the cam surfaces of the arm and the roller cooperatively function to positively define an intermediate position at which the door may be located relative to the vehicle body.

In another known arrangement, a check strap arrangement includes checking mechanism that cooperates with a link member. Such an arrangement is shown and described in U.S. Pat. No. 5,173,991 which is hereby incorporated by reference.

While known arrangements have proven to be commercially acceptable, they are all associated with specific disadvantages and thereby subject to improvement. In this regard, some known designs include a metal-to-metal interface exists between the roller and cooperating arm which requires lubrication. Further, the proximity of known check straps, in between the door and the vehicle body, subjects the lubricated interface to contamination from dirt, moisture and the like. During use of the vehicle, the noted contaminants are splashed, sloshed and otherwise introduced into the area between the vehicle door and the vehicle body, thereby threatening to adversely affect operation of the check strap. These adverse affects on operation of the check strap range from undesirable squeaking to inoperability which requires replacement.

SUMMARY OF THE INVENTION

It is a principal object of the present invention to provide a check strap assembly for a passenger door of a motor vehicle having improved reliability and increased performance life.

It is a related object of the present invention to provide a check strap assembly for a passenger door of a motor vehicle having components which are protected from contamination.

It is a more particular object of the present invention to provide a check strap assembly for a passenger door of a motor vehicle which has a simple construction with cooperating components effectively sealed within an interior cavity of the vehicle door when the vehicle door is closed.

The present invention comprises an improvement over prior known check straps for motor vehicle doors, including those discussed above. More particularly, the present invention provides a new and improved check strap assembly for a vehicle door which includes a translatable seal for preventing dirt, moisture and other contaminants from adversely affecting performance of the check strap assembly. In the preferred embodiment, the check strap assembly includes an arm having a first end interconnected with the vehicle body and a second end interconnected to the vehicle door. A locating mechanism is disposed within the interior of the vehicle door. Advantageously, the present invention provides a sealing mechanism carried by the arm and adapted effectively seal the interior of the vehicle door when the vehicle door is in a closed position and the check strap assembly is most vulnerable to contamination from dirt, moisture, and the like.

In one form, the present invention provides a check strap assembly for positively locating a door of a motor vehicle relative to a body of the motor vehicle. The check strap assembly includes an arm having a first end interconnected to the body of the vehicle and a second end interconnected to the door. The arm extends through an aperture in a panel of the door. The check strap assembly further includes a seal member operative to seal the aperture in the panel of the door. The seal member is carried by the arm such that the seal member abuts the panel of the door when the door is in the closed position and is spaced from the panel of the door when the door is in the fully open position.

In a more preferred form, the present invention provides a check strap assembly for positively locating a passenger door of a motor vehicle relative to a body of the motor vehicle. The door has a panel with an aperture and is movable relative to the body between a fully open and closed position. The check strap assembly includes a locating mechanism disposed within the door and interconnected to the panel of the door. The locating mechanism includes a channel which extends therethrough. The check strap assembly additionally includes an arm having a first end pivotally interconnected to the body of the vehicle. The arm extends through the channel of the locating mechanism and through the aperture in the panel of the door. The arm is translatable relative to the locating mechanism and the door. The check strap assembly further includes a seal member operative to seal the aperture in the panel of the door. The seal member is carried by the arm such that the seal member abuts the panel of the door when the door is in the closed position and is spaced from the panel of the door when the door is in the fully open position.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
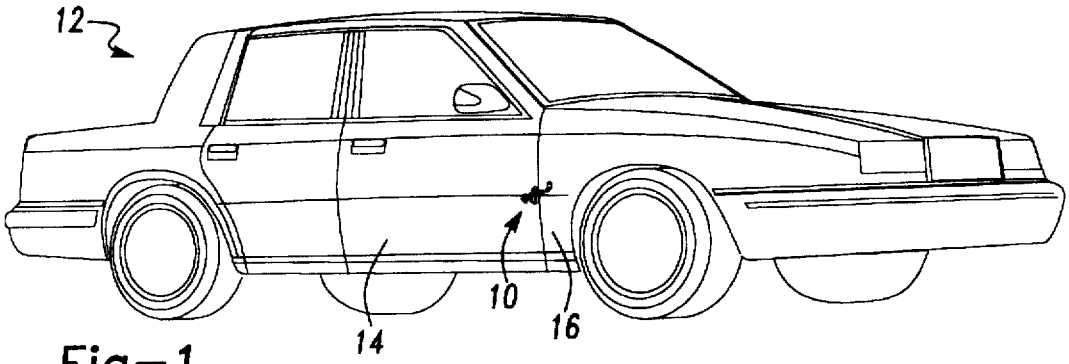
FIG. 1 is an environmental view of a check strap assembly constructed in accordance with the teachings of the preferred embodiment of the present invention and shown operatively installed within a vehicle so as to interconnect a passenger door with the body of the vehicle.

The present invention provides an improved check strap assembly specifically intended for use with a passenger door of a motor vehicle. As will be discussed below, the check strap assembly of the present invention is shown in the drawings operatively associated with a right, front passenger door of a motor vehicle. However, those skilled in the art will appreciate that the invention is not so limited in scope.

Turning generally to the drawings in which identical or equivalent elements have been denoted with like reference numerals, a check strap assembly constructed in accordance with the teachings of the preferred embodiment of the present invention is illustrated and identified with reference numeral 10. As shown in FIG. 1, the check strap assembly 10 is installed on an otherwise conventional vehicle 12 and functions to operatively interconnect a passenger door 14 of the vehicle 12 with the body 16 of the vehicle 12. The intended purpose of the check strap assembly 10 to positively locate the passenger door 14 at an intermediate position between a fully open position and a fully closed position will become apparent below.

Figure 2:
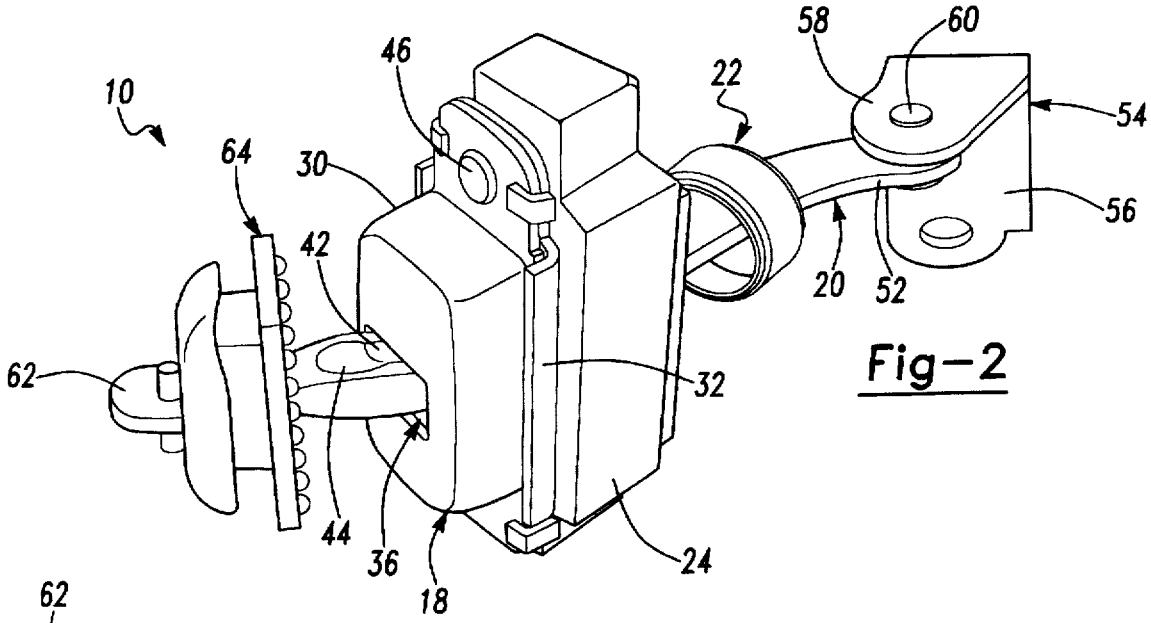
FIG. 2 is an enlarged perspective view of the check strap assembly of FIG. 1 shown removed from the vehicle for purposes of illustration.
Figure 3:
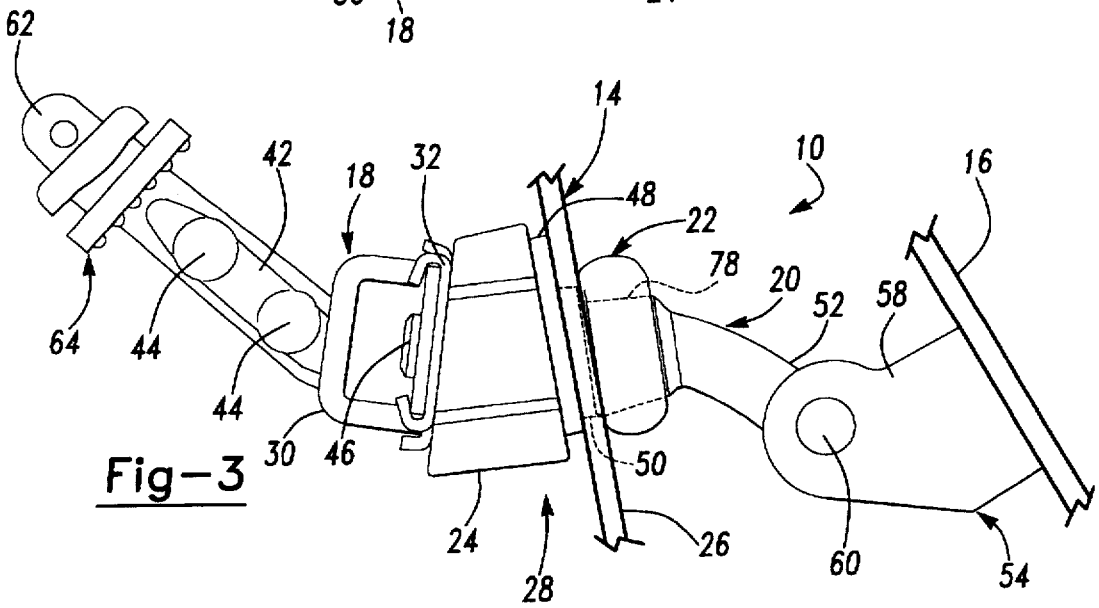
FIG. 3 is a top view of the check strap assembly of FIG. 2, illustrating the check strap assembly as the vehicle door is in a closed position relative to the vehicle body and showing the check strap assembly attached to a panel of the passenger door and to the body of the vehicle.
Figure 4:
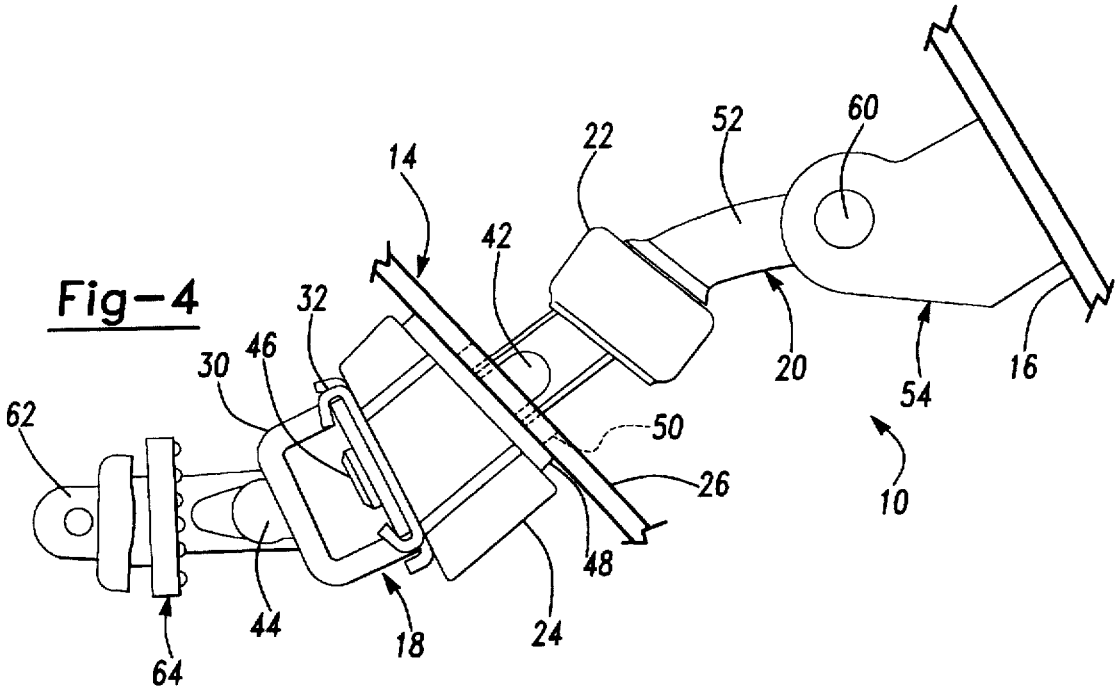
FIG. 4 is a top view of the check strap assembly similar to FIG. 3, illustrating the check strap assembly as the vehicle door is in an intermediate position relative to the vehicle body.
Figure 5:
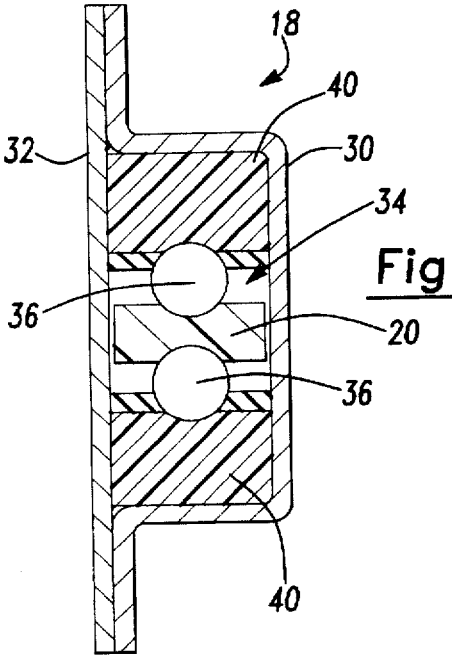
FIG. 5 is a cross-sectional view of the locating mechanism of FIG. 2.

With reference now to FIGS. 2–4, the check strap assembly 10 of the present invention is shown to generally include a locating mechanism 18, a cooperating arm 20, and a seal member 22 carried by the arm 20. The locating mechanism 18 is crimped or otherwise suitably fastened to an adapter plate 24 which is in turn bolted, or otherwise suitably fastened to an inner side of a forward panel 26 of the passenger door 14. As a result, the locating mechanism 18 and the adapter plate 24 are disposed within an interior chamber 28 (partially shown in FIG. 3) of the passenger door 14 which defined in part by the forward panel 26. Much of the focus of the present invention is directed to the seal member 22 which operates to prevent entry of contaminants such as dirt, moisture, and the like, into the interior chamber 28 of the vehicle door 14 when the vehicle door 14 is in a closed position (as shown in FIG. 1). As such, the seal member 22 serves to improve the reliability and increase the performance of the check strap assembly 10. Prior to describing the specific construction and function of the seal member 22 of the preferred embodiment of the present invention, an understanding of the remaining components of the check strap assembly 10, which will be understood to be largely exemplary in nature, is warranted.

As shown in FIGS. 2–5, the locating mechanism 18 of the check strap assembly 10 includes two housing portions 30 and 32 which are crimped together and define an internal cavity 34. A channel 35 passes through the locating mechanism 18 through which the arm 20 passes. Disposed within the internal cavity 34 of the locating mechanism 18 are a pair of locating balls or bearings 36 and a cooperating pair of compressible members 40. The bearings 36 are located on opposite sides of the arm 20 and are biased into engagement with the arm 20 by the compressible members 40. A significant force is required to compress the compressible members 40 and thereby vertically displace the bearings 36. The bearings 36 ride along longitudinally extending grooves 42 formed in opposite side of the arm 20. As will be more apparent below, the locating mechanism 18 is positively located relative to the arm 20, and in turn, the passenger door 14 is positively located relative to the body 16 of the vehicle 12 through engagement of the bearings 36 with circular recesses 44 formed within the longitudinal extending grooves 42 of the arm 20. In the embodiment illustrated, the locating mechanism 18 is attached to the adapter plate 24 with threaded fasteners 46.

As shown in FIGS. 3 and 4, the adapter plate 24 is attached to a forward panel 26 of the vehicle door 14. While not specifically shown, it will be understood that the adapter plate 24 may be attached with threaded fasteners or any other suitable manner well known in the art. As shown in FIGS. 3 and 4, a foam pad 48 is disposed between the adapter plate 24 and the forward panel 26 of the vehicle door 14. Through the adapter plate 24, the locating mechanism 18 can be positioned properly with respect to the front panel 26 of the door 14. In this regard, a common locating mechanism 18 can be used for various applications through the use of suitable adapter plates 24. As with the locating mechanism 18, the adapter plate 24 defines channel (not specifically shown) through which the arm 20 extends. The channels of the adapter plate 26 and the locating mechanism 18 aligned with a generally cylindrical aperture 50 provided in the forward plate 26 of the vehicle door 14.

With continued reference to FIGS. 2–4, the arm 20 of the check strap assembly 10 is shown to include a first end 52 attached to the body 16 of the vehicle 12. More specifically, the first end 52 of the arm 20 is pivotally interconnected to the body 16 of the vehicle 12 through a mounting member 54. In the exemplary embodiment illustrated, the mounting member 54 includes a mounting portion 56 for attachment to the body 16 with bolts (not shown) and a flange 58 disposed perpendicular thereto having an aperture (not shown). The aperture receives a pivot pin 60 which passes through an aperture (not shown) formed in the first end 52.

As discussed above, opposite sides of the arm 20 are formed to include the longitudinally extending grooves 42. The longitudinally extending grooves 42 receive the bearings 36 of the locating mechanism 18 and serve to limit translation of the arm 20 relative to the locating mechanism 18. The cylindrical recesses 44 formed on the opposite sides of the arm 20 cooperate with the bearings 36 of the locating mechanism 18 to define a fully open position of the vehicle door 14 relative to the vehicle body 16 and an intermediate position between the fully open position and the closed position. In the top view of FIG. 3, the check strap assembly 10 is illustrated when the vehicle door 14 is in its closed position. In the top view of FIG. 4, the check strap assembly 10 is illustrated when the vehicle door 14 is in its intermediate position. Adjacent a second end 62 of the arm 20, the check strap assembly 10 is shown to include a stop mechanism 64 for further insuring that the vehicle door 14 is not pivoted beyond its fully open position.

Figure 6:
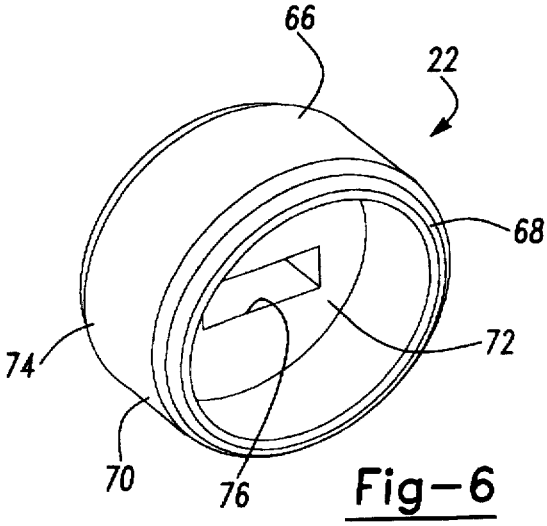
FIG. 6 is a perspective view of the seal member of the present invention.

With continued reference specifically to FIGS. 2–4 and additional reference to FIG. 6, the operation construction of the seal member 22 of the check strap assembly 10 will now be described. The seal member 22 is shown to include a continuous sidewall 66 which is concavely curved in side view. The seal member 22 additionally includes a circular flange 68 adjacent a first end 70 and a top portion 72 adjacent a second end 74. The top portion 72 is formed to include a generally rectangular aperture 76 through which the arm 20 is permitted to pass. As shown in phantom in FIG. 3, the sides of the aperture 76 are received in a groove 78 formed in the arm 20, thereby attaching the seal member 22 for relative movement with the arm 20. In the preferred embodiment, the seal member is unitarily constructed of an elastomeric material, however, it will be appreciated by those skilled in the art that various other similar materials may be alternatively employed.

With particular reference to FIGS. 3 and 4, the operation of the check strap assembly 10 heretofore detailed will now be described. When the vehicle door 14 is pivotally displaced from its closed position, the seal member 22 is displaced from the forward panel 26 of the door 14. When the vehicle door 14 is rotated to its closed position, the cylindrical flange 68 extends into the aperture 50 formed in the forward panel 26 and the continuous sidewall 66 of the seal member 22 is slightly compressed. This slight compression of the seal member 22 (as shown in FIG. 3) presses the continuous sidewall 66 against a portion of the front panel 26 which is circumferentially adjacent to the aperture 50. As a result, the interior chamber 28 of the door 14 is seal from contamination when the door 14 is in the closed position.

While the above description constitutes the preferred embodiment of the invention, it will be appreciated that the invention is susceptible to modification, variation, and change without departing from the proper scope or fair meaning of the accompanying claims.

What is claimed is:

1. A check strap assembly for a closure member and a frame, the closure member moveable in relation to the frame between an open position and a closed position, the check strap assembly comprising:

an arm passing through an aperture in the closure member, said arm having a first end interconnected to the frame and a second end retained within the closure member such that said closure member may be selectively moved relative to said arm; and a seal member carried by said arm, said seal member operative to seal said aperture when the closure member is moved to the closed position.

2. The check strap assembly of claim 1, wherein said seal member is displaced from the closure member when the closure member is in the open position.

3. The check strap assembly of claim 2, wherein said seal member is compressed as the closure member is moved from the open position to the closed position.

4. A check strap assembly for positively locating a door of a motor vehicle relative to a body of the motor vehicle, the door defining an interior, including an aperture, and being moveable relative to the body between an open position and a closed position, the check strap assembly comprising:

an arm having a first end interconnected to the body of the vehicle and a second end retained within the interior of the door, said arm extending through an aperture in a panel of the door and being moveable relative to the door as the door is moved between the open position and the closed position;

a checking mechanism operatively associated with the arm, the checking mechanism being located within the interior of the door; and a seal member carried by the arm and operative to seal the aperture in the door when the door is in the closed position;

whereby said seal member prevents moisture and other contaminants from entering the interior of the door when the door is in the closed position.

5. The check strap assembly of claim 4, wherein said seal member is a compressible bulb seal.

6. The check strap assembly of claim 5, wherein said seal member is displaced from the closure member when the closure member is in the open position.

7. The check strap assembly of claim 6, wherein said seal member is compressed as the closure member is moved from the open position to the closed position.

8. A method of preventing moisture and other contaminants from entering the interior of a vehicle door through an aperture provided for an arm of a check strap assembly, the method comprising the steps of:

providing a seal member for sealing the aperture of the door;

attaching the seal member to the arm of the check strap assembly for movement therewith; and moving said sealing member into operative engagement with said aperture through movement of the door between an open position and a closed position.

9. The method of claim 8, further comprising the step of inserting a forward portion of said seal member into said aperture.

10. The method of claim 9, further comprising the step of compressing a portion of said seal member against the door about the perimeter of the aperture.

* * * * *